US009879939B2

(12) United States Patent
McPherson

(10) Patent No.: US 9,879,939 B2
(45) **Date of Patent: *Jan. 30, 2018**

(54) CROSSBOW WITH VARIABLE CABLE DISPLACEMENT

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/359,364

(22) Filed: Nov. 22, 2016

(65) Prior Publication Data

US 2017/0074615 A1 Mar. 16, 2017

Related U.S. Application Data

(63) Continuation of application No. 14/940,037, filed on Nov. 12, 2015, now Pat. No. 9,500,433.

(60) Provisional application No. 62/079,370, filed on Nov. 13, 2014.

(51) Int. Cl.
*F41B 5/12* (2006.01)
*F41B 5/14* (2006.01)

(52) U.S. Cl.
CPC ..... *F41B 5/1403* (2013.01); *F41B 5/123* (2013.01); *F41B 5/1411* (2013.01)

(58) Field of Classification Search
CPC ..... F41B 5/123
See application file for complete search history.

(56) References Cited

U.S. PATENT DOCUMENTS

| | | | | |
|---|---|---|---|---|
| 5,651,355 | A | 7/1997 | Gallops, Jr. | |
| 5,983,880 | A | 11/1999 | Saunders | |
| 6,267,108 | B1 | 7/2001 | McPherson et al. | |
| 8,651,095 | B2 | 2/2014 | Islas | |
| 8,991,375 | B2 | 3/2015 | McPherson | |
| 9,068,791 | B2 | 6/2015 | McPherson | |
| 9,200,863 | B2 | 12/2015 | Bednar | |
| 9,255,757 | B2 | 2/2016 | McPherson | |
| 9,500,433 | B2 * | 11/2016 | McPherson | F41B 5/1403 |
| 2002/0096160 | A1 | 7/2002 | Gallops, Jr. | |
| 2011/0203561 | A1 | 8/2011 | Shaffer et al. | |
| 2011/0308508 | A1 | 12/2011 | Islas | |
| 2013/0055997 | A1 | 3/2013 | Badgerow | |
| 2013/0213373 | A1 | 8/2013 | Biafore, Jr. | |
| 2014/0069402 | A1 | 3/2014 | McPherson | |
| 2015/0285582 | A1 | 10/2015 | Chang | |

* cited by examiner

*Primary Examiner* — John Ricci

(57) ABSTRACT

In at least one embodiment, a crossbow comprises a stock defining a shooting axis and a bow portion comprising a bowstring and a cable. The stock comprises an aperture formed therein and the cable extends through the aperture. A surface of the aperture biases the cable in a direction lateral to the shooting axis. At least a portion of the surface is oriented non-parallel to the shooting axis.

19 Claims, 6 Drawing Sheets

CROSSBOW WITH VARIABLE CABLE DISPLACEMENT

CROSS-REFERENCE TO RELATED APPLICATIONS

This application is a continuation application that claims the benefit of U.S. patent application Ser. No. 14/940,037, filed Nov. 12, 2015, which claims the benefit of U.S. Provisional Application No. 62/079,370, filed Nov. 13, 2014, the entire disclosures of which are hereby incorporated herein by reference.

BACKGROUND OF THE INVENTION

This invention relates generally to crossbows and more particularly to compound crossbows.

Compound crossbows are known in the art, and generally include a bowstring and harness cable system. The harness cables often include dual power cables in a two-cam bow system, or alternatively, one power cable and a secondary or control cable in a single-cam or hybrid/1.5 cam bow.

While the bowstring propels an arrow along a shooting axis, the harness cables are generally displaced in a direction lateral to the shooting axis to avoid interfering with the arrow. For example, the harness cables can extend through the stock of the crossbow, and the stock holds the cables in a laterally displaced position. An example of a crossbow having harness cables that pass through the stock is disclosed in US 2014/0069402, the entire disclosure of which is hereby incorporated herein by reference.

The harness cables hold high amounts of tension, and the lateral displacement results in the cables applying relatively high lateral loads to the stock or any intermediary components positioned between the cable(s) and stock, such as a cable slide. For example, in a brace condition, the harness cables can apply a force of 30 pounds or more to the stock. When the crossbow is cocked, the tension in the harness cables can increase twofold or greater, resulting in a force of 60 pounds or more being applied to the stock. The frictional forces between components decreases the efficiency of the crossbow.

The displacement of the harness cables can also cause limb torsion and cam lean, which generally increase as the crossbow is drawn.

There remains a need for novel crossbow designs that reduce internal forces and increase the efficiency of the crossbow. There remains a need for novel crossbow designs that minimize limb torsion and cam lean.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, a crossbow comprises a stock defining a shooting axis and a bow portion comprising a bowstring and a cable. A cable positioner is arranged to bias the cable in a direction lateral to the shooting axis. The cable positioner moves with respect to the stock along a travel path as the bow is drawn. At least a portion of the travel path is non-parallel to the shooting axis.

In at least one embodiment, a crossbow has a first draw orientation and a second draw orientation. The crossbow comprises a stock defining a shooting axis and a bow portion comprising a bowstring and a cable. A cable positioner is arranged to bias the cable in a direction lateral to the shooting axis. The crossbow defines a distance between the shooting axis and the cable, and the distance in the first draw orientation is different from the distance in the second draw orientation.

In at least one embodiment, a crossbow comprises a stock defining a shooting axis and a bow portion comprising a bowstring and a cable. The stock comprises an aperture formed therein and the cable extends through the aperture. A surface of the aperture biases the cable in a direction lateral to the shooting axis. At least a portion of the surface is oriented non-parallel to the shooting axis.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
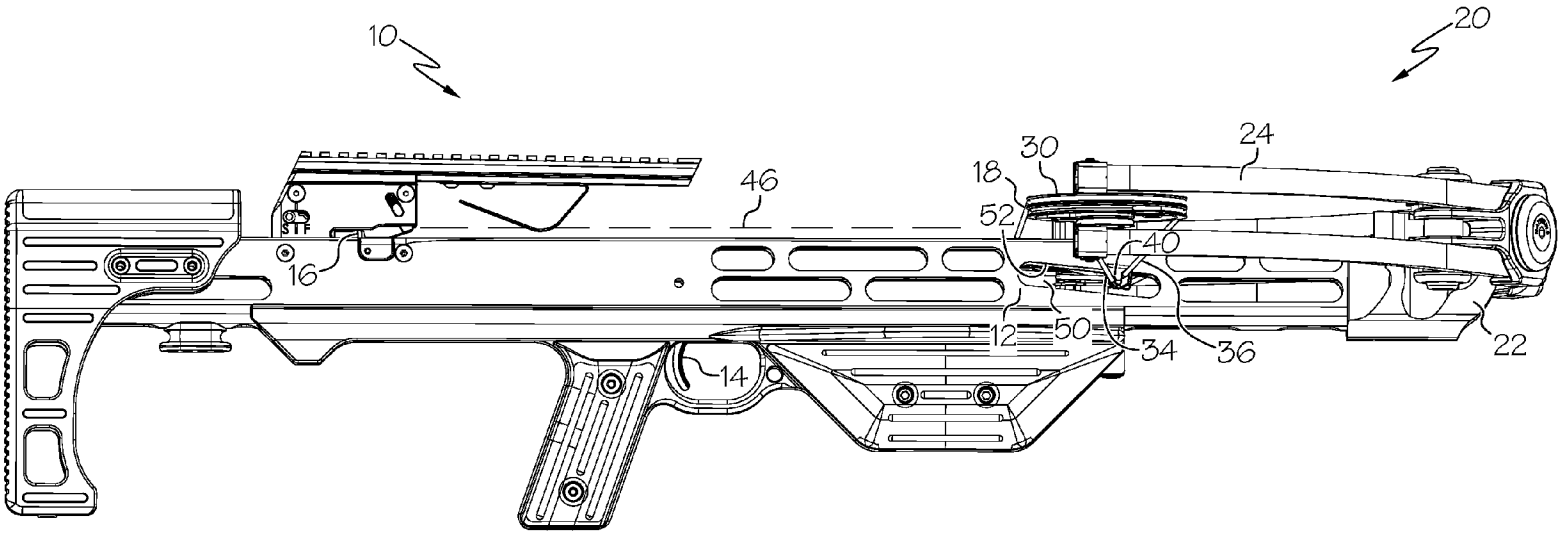
FIGS. 1 and 2 show an embodiment of a crossbow in a brace condition.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
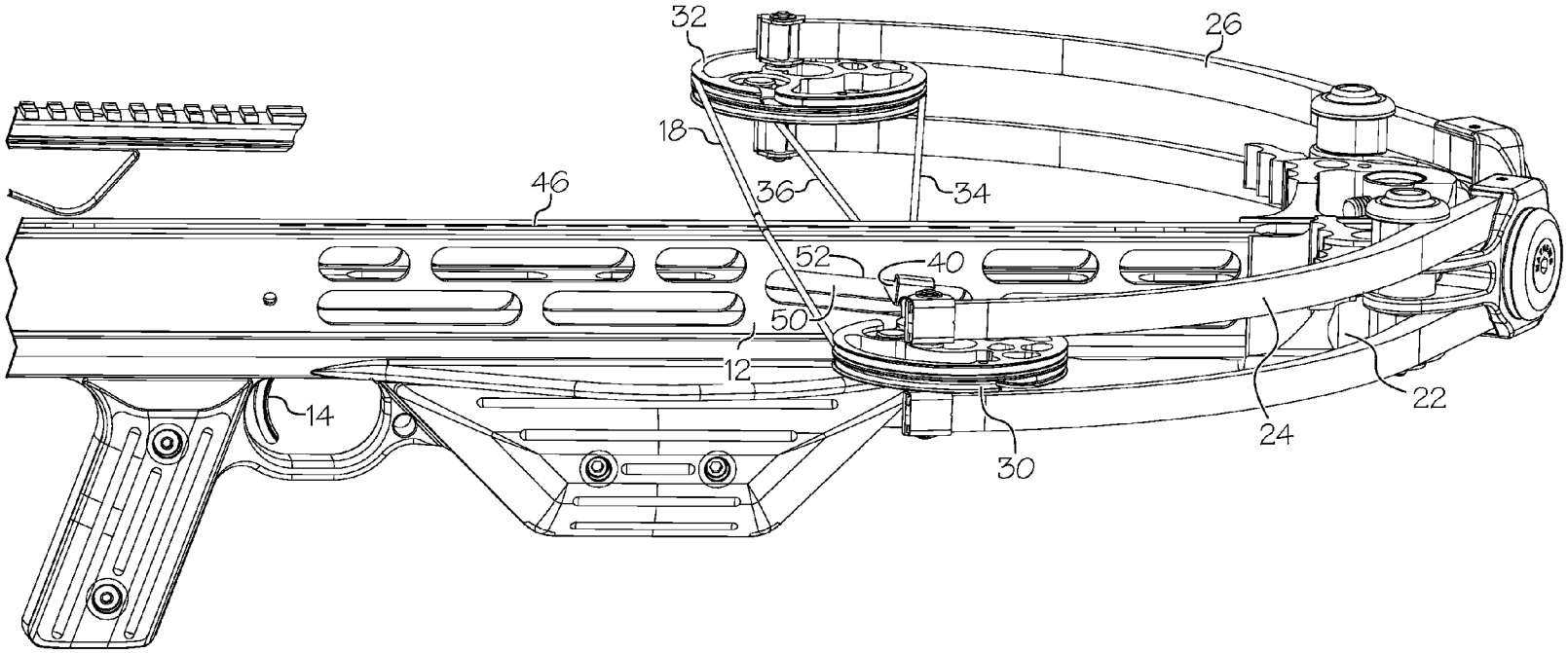

FIGS. 1 and 2 show an embodiment of a crossbow 10 in an undrawn or brace orientation. Desirably, the crossbow 10 comprises a stock 12, a trigger 14, a string latch 16 and a bow portion 20. The stock desirably defines a shooting axis 46. The bow portion 20 can comprise any suitable type of bow. In some embodiments, the bow portion 20 comprises a prod 22 that attaches the stock 12, a first limb 24 and a second limb 26. In some embodiments, the limbs 24, 26 are supported by the prod 22. In some embodiments, the limbs 24, 26 comprise "split limb" members, each comprising two limb portions.

Desirably, the bow portion 20 comprises a first rotatable member 30 and a second rotatable member 32. In some embodiments, the first rotatable member 30 is supported by the first limb 24 and the second rotatable member 32 is supported by the second limb 26.

In some embodiments, a bowstring 18 is attached at one end to the first rotatable member 30 and attached at another end to the second rotatable member 32.

Desirably, the bow portion 20 comprises a harness cable system comprising at least a first cable 34. In some embodiments, the harness cable system comprises a second cable 36. In some embodiments, both cables 34, 36 comprise power cables. In some embodiments, the first cable 34 comprises a power cable and the second cable 36 comprises a control cable.

In some embodiments, the cables 34, 36 pass through a portion of the stock 12. In some embodiments, the crossbow 10 comprises a cable positioner 40 that positioned the cables 34, 36. An example of a cable positioner 40 is disclosed in US 2014/0069402.

In some embodiments, an aperture or slot 50 is formed in the stock 12, and the cable positioner 40 moves along a portion of the slot 50. For example, in some embodiments, the cables 34, 36 bias the cable positioner 40 against an upper surface of the slot 50. As the crossbow 10 is drawn, the position of the rotatable members 30, 32 changes as the limbs 24, 26 flex, and the cable positioner 40 moves in accordance with the position of the cables 34, 36.

In some embodiments, a surface 52 of the slot 50 biases and displaces the cable(s) 34, 36 away from the shooting axis 46. In some embodiments, the cable positioner 40 moves along the surface 52 as the crossbow is drawn. In some embodiments, the surface 52 comprises a guide for the cable positioner 40 and defines a travel path of the cable positioner 40.

In some embodiments, at least a portion of the surface 52 is non-parallel to the shooting axis 46, and an amount of lateral displacement of the cables 34, 36 caused by the stock 12 changes as the bow portion 20 is drawn and the cable positioner 40 moves along the surface 52.

In some embodiments, a distance between the shooting axis 46 and the first cable 34 in a first draw orientation is different from the distance in a second draw orientation. For example, in some embodiments, a distance between the shooting axis 46 and the first cable 34 in a brace orientation is different from the distance in a cocked orientation. The distance desirably comprises a shortest distance between the shooting axis 46 and the first cable 34, and the distance can be measured in a direction orthogonal to the shooting axis 46.

In some embodiments, the distance in a first draw orientation is greater than the distance in a second draw orientation, and the second draw orientation comprises a greater amount of draw than the first draw orientation. Thus, in some embodiments, as the crossbow is drawn and tension in the cable 34 increases, the lateral displacement of the cable 34 away from the shooting axis 46 decreases. In some embodiments, an amount of cam lean induced by the cables(s) 34, 36 remains relatively constant throughout the draw cycle.

Figure 3:
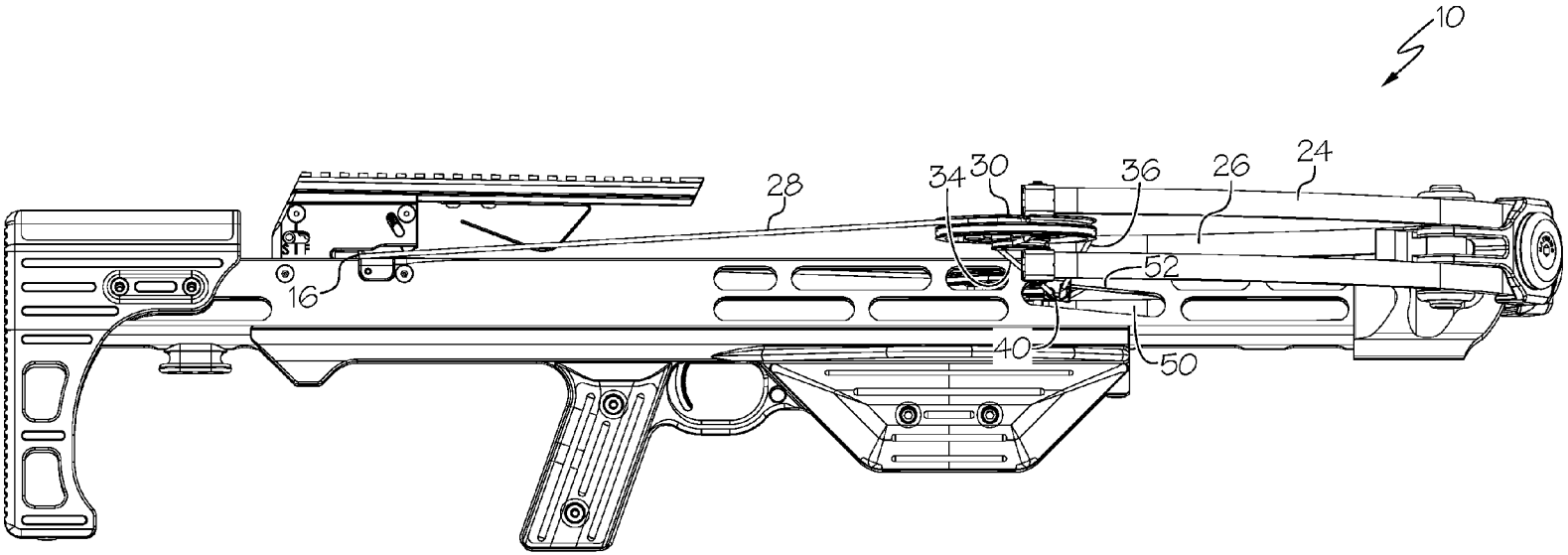
FIGS. 3 and 4 show the crossbow of FIG. 1 in a cocked condition.
Figure 4:
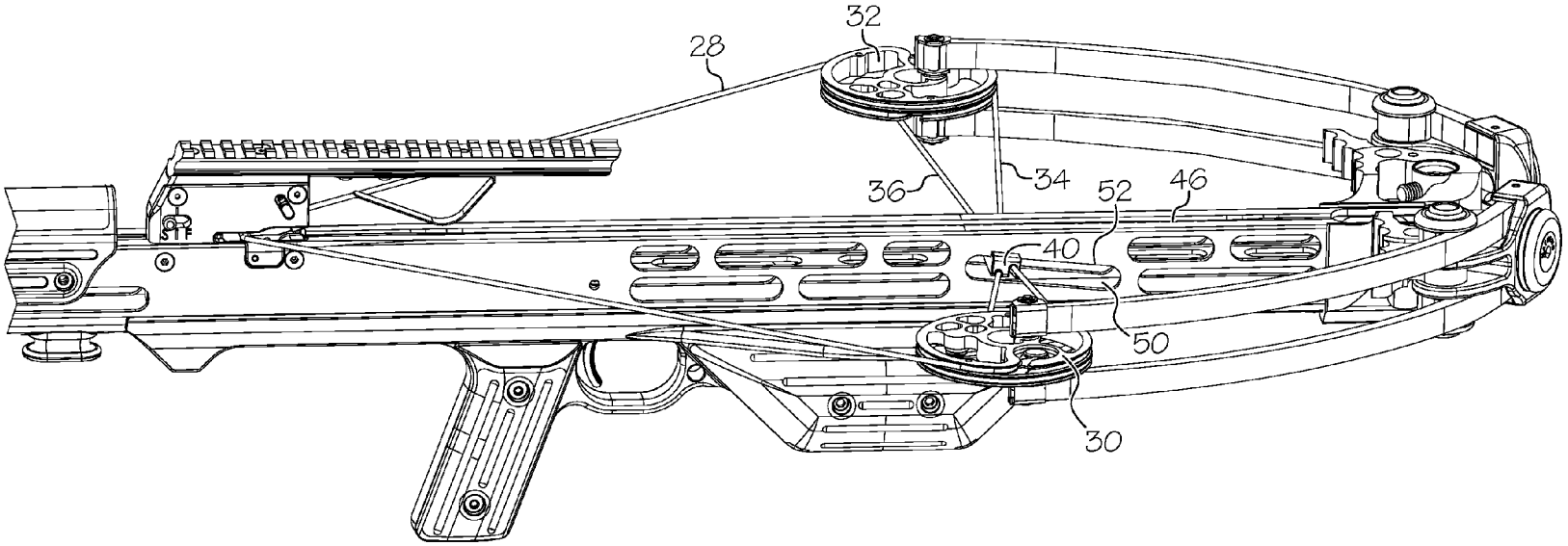

FIGS. 3 and 4 show the crossbow 10 of FIG. 1 in a cocked orientation. The bowstring 28 is held by the latch 16 in a full draw orientation. The rotatable members 30, 32 and limbs 24, 26 have moved with respect to their positions in FIG. 1. The cable positioner 40 has been displaced rearward as it has been moved by the cables 34, 36 along the surface 52.

In some embodiments, the cables 34, 36 are positioned closer to the shooting axis 46 when the crossbow 10 is cocked than when the crossbow 10 is at brace. This arrangement is desirable because the lateral displacement is reduced when the forces in the cables 34, 36 are higher.

In some embodiments, the surface 52 of the slot 50 is inclined with respect to the shooting axis 46. In some embodiments, the surface 52 is declined with respect to the shooting axis 46.

In some embodiments, at least a portion of a travel path of the cable positioner 40 extends non-parallel to the shooting axis 46. In some embodiments, the travel path is inclined with respect to the bow portion 20, or is inclined with respect to the shooting axis 46. In some embodiments, the travel path is declined with respect to the bow portion 20, or is declined with respect to the shooting axis 46.

In some embodiments, the travel path of the cable positioner 40 extends between first and second locations of the cable positioner 40 at respective first and second draw orientations. In some embodiments, the travel path is linear. In some embodiments, the travel path comprises curvature.

In some embodiments, a distance between the shooting axis 46 and the cable positioner 40 in a first draw orientation is different from the distance in a second draw orientation. For example, in some embodiments, a distance between the shooting axis 46 and the cable positioner 40 in a brace orientation is different from the distance in a cocked orientation.

Figure 5:
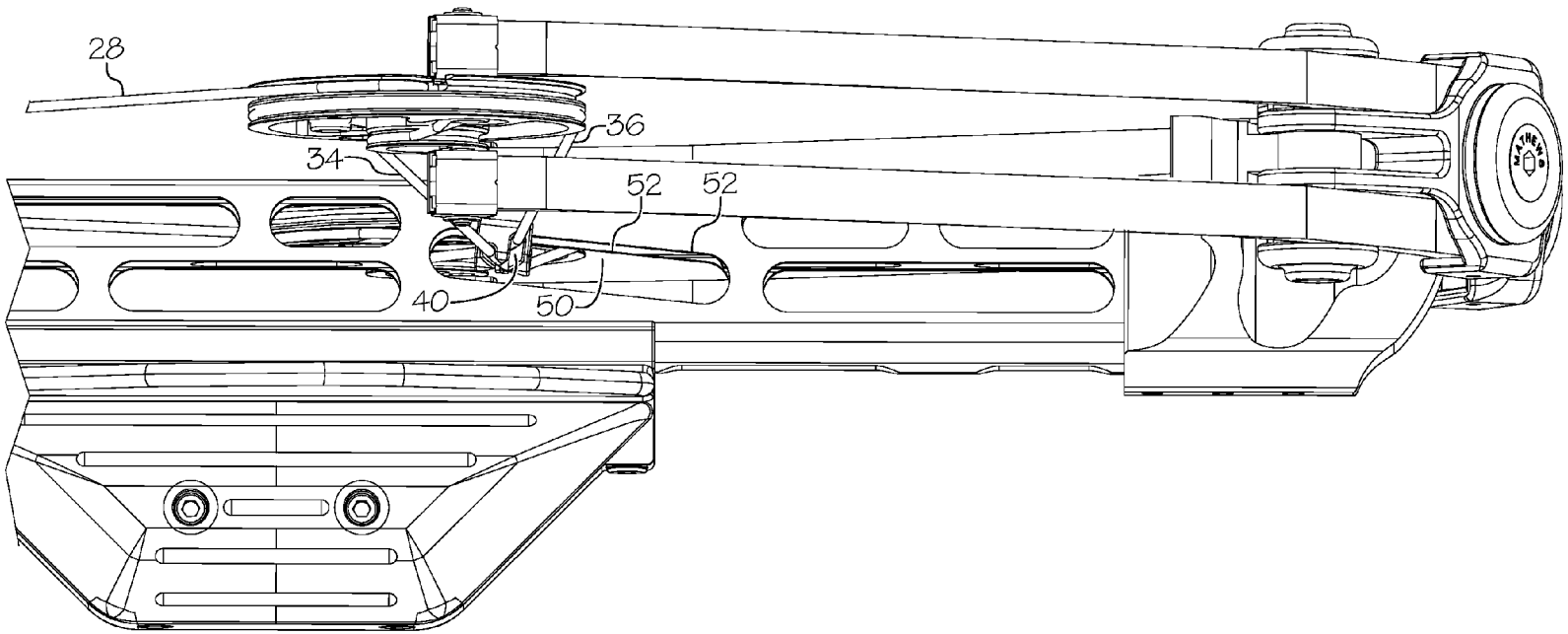
FIG. 5 shows a portion of an embodiment of a crossbow in greater detail.

FIG. 5 shows an embodiment of the aperture or slot 50 in greater detail.

A travel path of the cable positioner 40, and/or the surface 52 of the aperture 50 can be oriented at any suitable non-zero angle to the shooting axis 46. In some embodiments, the angle ranges from greater than zero to less than ninety degrees. In some embodiments, the angle ranges from greater than zero to less than forty-five degrees. In some embodiments, the angle ranges from greater than zero to less than twenty degrees. In some embodiments, the angle ranges from two to ten degrees. In some embodiments, the angle ranges from five to seven degrees.

In some embodiments, a cable positioner 40 is positioned to allow for clearance of an arrow vane. Although the cable positioner 40 will move to a second position when the crossbow is cocked, upon firing, the cable positioner 40 move back toward the first position and desirably provide clearance for the arrow vane. In some embodiments, the vane of an arrow 56 will overlap a portion of the slot 50 and/or overlap a portion of the surface 52.

The slot 50 may have any suitable shape and orientation. The surface 52 of the slot 50 can also follow any suitable contour. FIG. 5 shows a surface 52 that is linear and defines a linear travel path.

Figure 6:
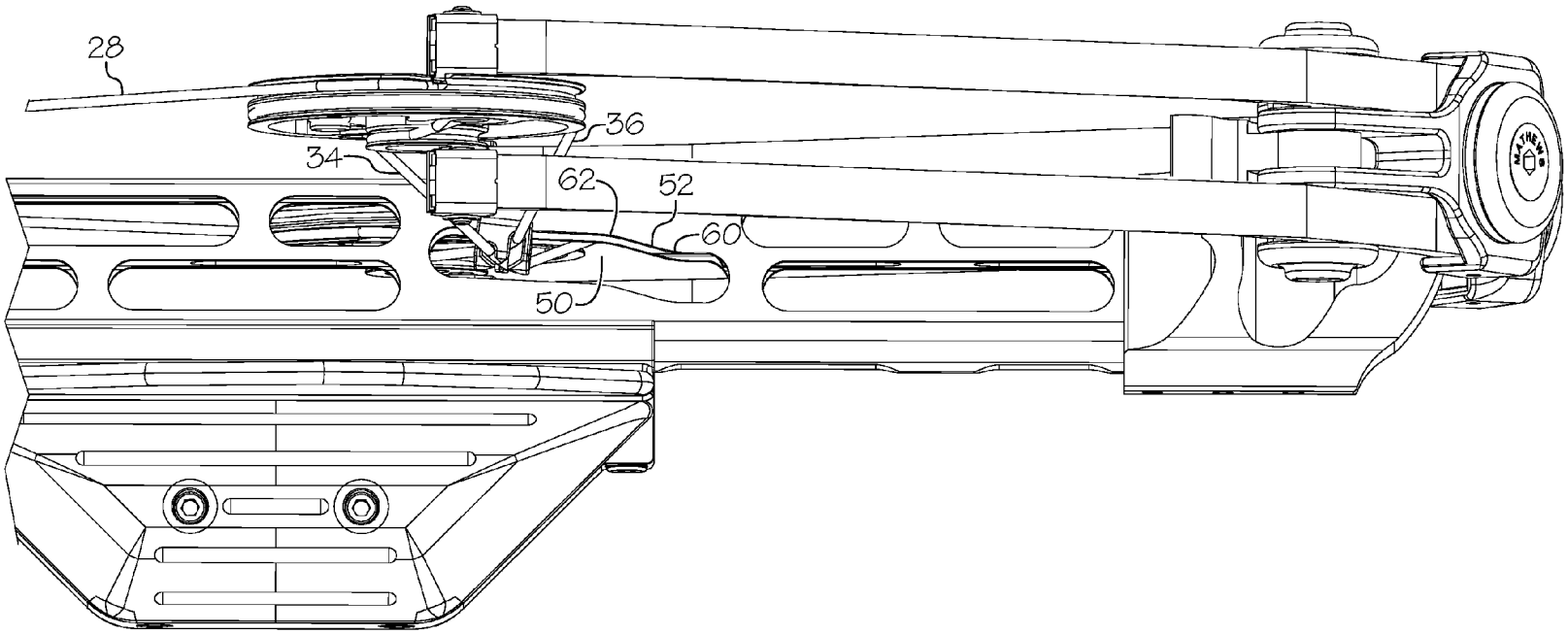
FIG. 6 shows another embodiment of a crossbow.

FIG. 6 shows another embodiment of a slot 50, wherein a surface 52 comprises curvature. The surface 52, and/or the travel path, can have any suitable type and amount of curvature. In some embodiments, a portion of the surface 52, and/or the travel path, defines a parabolic shape. In some embodiments, a portion of surface 52, and/or the travel path, comprises curvature that is concave 60 with respect to the shooting axis 46. In some embodiments, a portion of surface 52, and/or the travel path, comprises curvature that is convex 62 with respect to the shooting axis 46. In some embodiments, the specific curvature and displacement can be optimized to follow specifics of the draw force curve of the crossbow, for example, allowing the cable(s) 34, 36 to traverse closer to the shooting axis 46 in conjunction with increases in tension in the cable(s) 34, 36.

The above disclosure is intended to be illustrative and not exhaustive. This description will suggest many variations and alternatives to one of ordinary skill in this field of art.

All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a stock defining a shooting axis;

a bow portion comprising a first limb supporting a first rotatable member, a second limb supporting a second rotatable member, a bowstring extending between the first and second rotatable members, and a cable arranged to be taken up on the first rotatable member; and a cable positioner arranged to bias said cable away from the shooting axis, said cable separated from said shooting axis by a shortest distance as measured perpendicular to the shooting axis;

the crossbow having a first draw orientation and a second draw orientation, the shortest distance being greater in the first draw orientation than in the second draw orientation.

2. The crossbow of claim 1, wherein the stock comprises an aperture and the cable passes through the aperture.

3. The crossbow of claim 2, wherein the cable positioner contacts a surface of said stock that defines said aperture.

4. The crossbow of claim 3, wherein said surface is non-parallel to said shooting axis.

5. The crossbow of claim 1, said cable positioner having a first orientation with respect to the stock in the first draw orientation, said cable positioner having a second orientation with respect to the stock in the second draw orientation.

6. The crossbow of claim 1, further comprising a second cable, the second cable separated from said shooting axis by a distance as measured perpendicular to the shooting axis, the distance being greater in the first draw orientation than in the second draw orientation.

7. The crossbow of claim 6, the second cable arranged to be taken up on the second rotatable member.

8. The crossbow of claim 6, wherein said cable positioner biases said second cable away from the shooting axis.

9. The crossbow of claim 6, said cable positioner having a first orientation with respect to the stock in the first draw orientation, said cable positioner having a second orientation with respect to the stock in the second draw orientation.

10. The crossbow of claim 1, wherein said cable carries a higher amount of tension in the second draw orientation than in the first draw orientation.

11. A crossbow comprising:

a bow portion comprising a first limb supporting a first rotatable member, a second limb supporting a second rotatable member, a bowstring extending between the first and second rotatable members, and a cable arranged to be taken up on the first rotatable member; and a stock defining a shooting axis, the stock arranged to bias said cable away from the shooting axis, said cable separated from said shooting axis by a shortest distance as measured perpendicular to the shooting axis;

the crossbow having a first draw orientation and a second draw orientation, the shortest distance being greater in the first draw orientation than in the second draw orientation.

12. The crossbow of claim 11, wherein the stock comprises an aperture and the cable passes through the aperture.

13. The crossbow of claim 12, wherein a surface that defines said aperture is non-parallel to said shooting axis.

14. The crossbow of claim 11, said cable having a first orientation with respect to the stock in the first draw orientation, said cable positioner having a second orientation with respect to the stock in the second draw orientation.

15. The crossbow of claim 11, further comprising a second cable, the second cable separated from said shooting axis by a distance as measured perpendicular to the shooting axis, the distance being greater in the first draw orientation than in the second draw orientation.

16. The crossbow of claim 15, the second cable arranged to be taken up on the second rotatable member.

17. The crossbow of claim 15, wherein said stock comprises an aperture and the second cable passes through the aperture.

18. The crossbow of claim 15, said second cable having a first orientation with respect to the stock in the first draw orientation and a second orientation with respect to the stock in the second draw orientation.

19. The crossbow of claim 11, wherein said cable carries a higher amount of tension in the second draw orientation than in the first draw orientation.

* * * * *